US009376646B2

(12) United States Patent
Komatsubara

(10) Patent No.: US 9,376,646 B2
(45) **Date of Patent: *Jun. 28, 2016**

(54) LUBRICATING OIL COMPOSITION

(71) Applicant: JX Nippon Oil & Energy Corporation, Tokyo (JP)

(72) Inventor: Hitoshi Komatsubara, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/388,586

(22) PCT Filed: Nov. 9, 2012

(86) PCT No.: PCT/JP2012/079115

§ 371 (c)(1),
(2) Date: Sep. 26, 2014

(87) PCT Pub. No.: WO2013/145414

PCT Pub. Date: Oct. 3, 2013

(65) Prior Publication Data

US 2015/0018256 A1 Jan. 15, 2015

(30) Foreign Application Priority Data

Mar. 29, 2012 (JP) ..... 2012-076092

(51) Int. Cl.

| | |
|---|---|
| ***C10M 135/36*** | (2006.01) |
| ***C10M 173/02*** | (2006.01) |
| ***C10M 135/22*** | (2006.01) |
| ***C10M 141/10*** | (2006.01) |

(52) U.S. Cl.

CPC ..... *C10M 141/10* (2013.01); *C10M 2203/1025* (2013.01); *C10M 2207/289* (2013.01); *C10M 2209/084* (2013.01); *C10M 2215/04* (2013.01); *C10M 2215/042* (2013.01); *C10M 2215/08* (2013.01); *C10M 2215/086* (2013.01); *C10M 2215/102* (2013.01); *C10M 2215/28* (2013.01); *C10M 2219/022* (2013.01); *C10M 2219/024* (2013.01); *C10M 2219/046* (2013.01); *C10M 2219/106* (2013.01); *C10M 2223/043* (2013.01); *C10M 2223/049* (2013.01); *C10N 2220/022* (2013.01); *C10N 2230/06* (2013.01); *C10N 2230/42* (2013.01); *C10N 2230/43* (2013.01); *C10N 2230/76* (2013.01); *C10N 2240/04* (2013.01); *C10N 2240/042* (2013.01); *C10N 2240/044* (2013.01); *C10N 2240/045* (2013.01); *C10N 2240/102* (2013.01); *C10N 2240/103* (2013.01); *C10N 2240/104* (2013.01); *C10N 2240/14* (2013.01); *C10N 2240/30* (2013.01)

(58) Field of Classification Search

CPC ..... C10M 2219/10; C10M 2215/08; C10M 2223/041; C10M 2219/022

USPC ..... 508/272

See application file for complete search history.

(56) References Cited

U.S. PATENT DOCUMENTS

| | | | | |
|---|---|---|---|---|
| 6,051,536 | A | 4/2000 | Igarashi et al. | |
| 2004/0167041 | A1 | 8/2004 | Arimoto | |
| 2007/0111906 | A1* | 5/2007 | Milner et al. | 508/343 |
| 2010/0317554 | A1* | 12/2010 | Fuchi et al. | 508/428 |

FOREIGN PATENT DOCUMENTS

| | | | |
|---|---|---|---|
| EP | 1055722 | A1 | 11/2000 |
| EP | 2832832 | A1 | 2/2015 |
| JP | H08-3576 | A | 1/1996 |
| JP | H09-263782 | A | 10/1997 |
| JP | H10-306292 | A | 11/1998 |
| JP | H11-263993 | A | 9/1999 |

(Continued)

OTHER PUBLICATIONS

Int'l Search Report issued Jan. 15, 2013 in Int'l Application No. PCT/JP2012/079115.

(Continued)

*Primary Examiner* — Vishal Vasisth

(74) *Attorney, Agent, or Firm* — Panitch Schwarze Belisario & Nadel LLP

(57) ABSTRACT

A lubricating oil composition is provided having excellent torque capacity, shifting properties, and anti-wear properties for wet friction materials, which can maintain initial torque capacity and shifting properties for a long period of time, suitable for automatic and/or continuously variable transmissions. The lubricating oil composition contains a lubricating base oil and based on the total mass of the composition (A) 0.5 percent by mass or more of a fatty acid amide compound represented by formula (1); (B) 0.05 percent by mass or more of thiadiazole; and (C) 0.1 percent by mass of a phosphorus-containing additive, and contains sulfur in an amount of 0.2 percent by mass or more based on sulfur and phosphorus in an amount of 0.2 percent by mass or less based on phosphorus, the ratio of the sulfur basis percent by mass/the phosphorus basis percent by mass (S/P) being from 3.0 to 5.0:

(1)

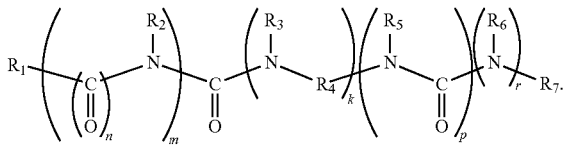

10 Claims, No Drawings

(56) References Cited

FOREIGN PATENT DOCUMENTS

| | | | |
|---|---|---|---|
| JP | 2000-355695 | A | 12/2000 |
| JP | 2001-323292 | A | 11/2001 |
| JP | 2003-073683 | A | 3/2003 |
| JP | 2012-012536 | A | 1/2012 |
| WO | 2007052826 | A1 | 5/2007 |

OTHER PUBLICATIONS

Extended Search Report issued Nov. 27, 2015 in EP Application No. 12872672.6.

* cited by examiner

LUBRICATING OIL COMPOSITION

CROSS-REFERENCE TO RELATED APPLICATION

This application is a Section 371 of International Application No. PCT/JP2012/079115, filed Nov. 9, 2012, which was published in the Japanese language on Oct. 3, 2013, under International Publication No. WO 2013/145414 A1, and the disclosure of which is incorporated herein by reference.

TECHNICAL FIELD

The present invention relates to lubricating oil compositions, more specifically to a lubricating oil composition which has long-lasting anti-shudder properties for a slip-controlled wet clutch in an automatic transmission and when applied in a belt type CVT of an automobile, exhibits μ-V characteristics of positive gradient as determined by a specific test to prevent the generation of belt noise while still maintaining metal-to metal friction coefficient high (maintaining power transmission capability high), particularly suitable for belt type continuously variable transmissions.

BACKGROUND ART

Recent automatic transmissions or continuously variable transmissions have been demanded to be light and small and sought to be improved in power transmission capability in connection with the increased power output of the engines with which the transmissions are used in combination. There are some automatic transmissions or continuously variable transmissions that control the lock-up clutch built in the torque converter to be slipped at a low velocity (slip lock-up control). These transmissions have been improved with the slip lock-up control so that the drive feeling can be improved by absorbing a torque variation and the engine torque can be transmitted to the transmission mechanism efficiently. Some of the continuously variable transmissions are provided with a wet starting clutch which is initially allowed to slip and then coupled so as to start the vehicle smoothly from the halt, that is a so-called slip control. Lubricating oils used for the transmissions wherein slip control for the lock-up clutch or starting clutch is carried out are required to provide excellent torque capacity and less shifting shock as well as to have excellent and long-lasting initial anti-shudder properties.

Continuously variable transmissions include a belt type CVT comprising a driving pulley, a driven pulley, and a belt for transmitting a power which belt is composed of a plurality of elements (hereinafter referred to as "tops") and a belt (steel belt) or chain connecting the elements together. Lubricating oils for such a belt type CVT have been required to have cooling, lubricating, and anti-wear properties and be enhanced in friction coefficient between the metal pulleys and the belt to obtain excellent power transmission capability.

In automobiles equipped with a belt type CVT, a phenomenon that belt noise generates may occur. It has been found that this phenomenon is caused by gear meshing sounds of the gears arranged behind the CVTs, resulting from a fluctuation in the rotation of the driven pulley. It has also been found that such a fluctuation occurs when the change in the friction coefficient (p) of the belt and tops over the change in the slipping velocity (V) is in a negative gradient (for example, see Patent Literature 1).

Another noise generates when the elements meshes into the pulleys.

Therefore, it is important for a belt type CVT and a continuously variable transmission having a slip-controlled wet clutch such as a lock-up clutch or a starting clutch to maintain anti-shudder properties for a long period of time and exhibit the metal-to-metal μ-V characteristics of positive gradient to prevent the generation of belt noise, while still maintaining the metal-to-metal friction coefficient between the metal pulleys and the metal belt high (maintaining the power transmission capability high).

Conventionally, as an transmission oil composition that can be improved in anti-belt-noise properties, a metal-to-metal friction coefficient and the durability of anti-shudder properties, Patent Literature 1, for examples, discloses an oil composition for continuously variable transmissions comprising a base oil blended with a sulfonate, an ashless dispersant, an acid amide, an organomolybdenum compound and an amine-based anti-oxidant such that the transmitted power can be kept large, the scratch phenomenon can be prevented, and furthermore the μ-V characteristics of positive gradient can be kept for a long time. Patent Literature 2 discloses a lubricating oil composition for automatic transmissions containing phosphorus:calcium:boron:sulfur in a specific elementary ratio so that the scratch phenomenon can be prevented for a long time. Patent Literature 3 discloses a continuously variable transmission lubricating oil composition containing an organic acid metal salt with a specific composition, an anti-wear agent, and a boron-containing succinimide, as essential components, to have both a higher metal-to metal friction coefficient and anti-shudder properties for a slip control mechanism. Patent Literature 4 discloses a long-lasting continuously variable transmission lubricating oil composition comprising calcium salicylate, a phosphorous-containing anti-wear agent, a friction modifier, and a dispersant type viscosity index improver, which composition has both a higher friction coefficient between metals and anti-shudder properties for a slip control mechanism. Patent Literature 5 discloses an automatic transmission fluid composition comprising calcium sulfonate, phosphorous acid esters and further a sarcosine derivative or a reaction product of a carboxylic acid and amine, which composition has long-lasting anti-shudder properties for a slip lock-up mechanism and long-lasting properties to prevent scratch noise in a belt type CVT.

However, the anti-belt-noise properties or anti-shudder properties and the metal-to-metal friction coefficient are in a trade-off relationship, and thus there is room for further improvements from the viewpoint of these properties.

CITATION LIST

Patent Literature

Patent Literature 1: Japanese Patent Application Laid-Open Publication No. 9-263782

Patent Literature 2: Japanese Patent Application Laid-Open Publication No. 2003-73683

Patent Literature 3: Japanese Patent Application Laid-Open Publication No. 2001-323292

Patent Literature 4: Japanese Patent Application Laid-Open Publication No. 2000-355695

Patent Literature 5: Japanese Patent Application Laid-Open Publication No. 10-306292

SUMMARY OF INVENTION

Technical Problem

In view of the above-described situations, the present invention has an object to provide a lubricating oil composition that can maintain anti-shudder properties for a slip-controlled wet clutch for a long period of time and exhibits the μ-V characteristics of positive gradient as determined by a specific test machine and specific test conditions to prevent the generation of belt noise, while still maintaining the metal-to metal friction coefficient between pulleys and a belt high (maintaining power transmission capability high), particularly suitable for belt type continuously variable transmissions.

Solution to Problem

As the results of the extensive studies, the present invention was accomplished on the basis of the finding that the above object was able to be achieved by a lubricating oil composition comprising a specific fatty acid amide compound, a sulfur-containing additive and a phosphorus-containing additive each in a specific amount and amount ratio.

That is, the present invention relates to a lubricating oil composition comprising a lubricating base oil and on the basis of the total mass of the composition (A) 0.5 percent by mass or more of a fatty acid amide compound represented by formula (1), (B) 0.05 percent by mass or more of thiadiazole and (C) 0.1 percent by mass of a phosphorus-containing additive, and containing sulfur in an amount of 0.2 percent by mass or more on the basis of sulfur and phosphorus in an amount of 0.2 percent by mass or less on the basis of phosphorus, the ratio of the sulfur basis percent by mass/the phosphorus basis percent by mass (S/P) being from 3.0 to 5.0.

(1)

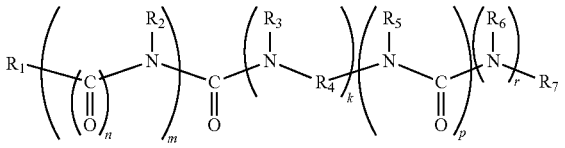

wherein $R_1$ is an alkyl or alkenyl group having 10 to 30 carbon atoms, $R_2$, $R_3$, $R_5$ and $R_6$ are each independently hydrogen or an alkyl group having 1 to 3 carbon atoms, $R_7$ is hydrogen or an alkyl or alkenyl group having 1 to 30 carbon atoms, $R_4$ is an alkylene group having 1 to 4 carbon atoms, k is an integer of 0 to 6, m is an integer of 0 to 2, and n, p and r are each an integer of 0 to 1.

Preferably, the lubricating oil composition of the present invention further comprises (D) a polysulfide in an amount of 0.05 percent by mass or more on the basis of the total mass of the composition.

Preferably, (D) the polysulfide is a sulfurized olefin represented by formula (5):

$$R^1—S_X—R^2 \quad (5)$$

wherein $R^1$ is an alkenyl group having 2 to 15 carbon atoms, $R^2$ is an alkyl or alkenyl group having 2 to 15 carbon atoms, and x is an integer of 4 to 8.

In the lubricating oil composition of the present invention, (C) the phosphorus-containing additive is preferably a phosphorous acid ester having an (alkyl)aryl group of 6 to 7 carbon atoms and/or a phosphorous acid ester having an alkyl group of 4 to 8 carbon atoms.

In the lubricating oil composition of the present invention, the value "b" is negative at oil temperatures of 60° C. and 100° C. when it is calculated using the following equation wherein X is time intervals of 2/100 second from 1 second to 3 seconds after the slipping speed is constantly accelerated from 0 m/s to 0.3 m/s for 1 second at a load of 2000 N using an LFW-1 test machine and Y is torque at each X:

$$b=(n\Sigma XY-(\Sigma X)(\Sigma Y))/(n\Sigma X^2-(\Sigma X)^2)$$

Advantageous Effect of Invention

The lubricating oil composition of the present invention can maintain the metal-metal friction coefficient high and is excellent in anti-seizure properties, particularly suitable for belt-type continuously variable transmissions.

The lubricating oil composition of the present invention is also excellent in performances required for transmission fluids other than those described above and thus is suitably used for the automatic or manual transmission and the differential gears, of automobiles, construction machines and agricultural machines. Moreover, the lubricating oil composition can be used as gear oils for industrial uses; lubricating oils for the gasoline engines, diesel engines or gas engines of automobiles such as two- and four-wheeled vehicles, power generators, and ships; turbine oils; and compressor oils.

DESCRIPTION OF EMBODIMENTS

The present invention will be described in detail.

No particular limitation is imposed on the lubricating base oil of the lubricating oil composition of the present invention, which may be a mineral base oil or synthetic base oil that is usually used in lubricating oil.

Specific examples of the mineral base oil include those which can be produced by subjecting a lubricating oil fraction produced by vacuum-distilling an atmospheric distillation bottom oil resulting from atmospheric distillation of a crude oil, to any one or more treatments selected from solvent deasphalting, solvent extraction, hydrocracking, solvent dewaxing, and hydrorefining; wax-isomerized mineral oils; and those produced by isomerizing GTL WAX (Gas to Liquid Wax).

The mineral based oil used in the present invention is preferably a hydrocracked mineral base oil. Alternatively, the mineral base oil is more preferably a wax-isomerized isoparaffin base oil, which is produced by isomerizing a raw material oil containing 50 percent by mass or more of wax such as a petroleum-based wax or Fischer-Tropsch synthetic oil. These base oils may be used alone or in combination Specific examples of the synthetic base oils include polybutenes and hydrogenated compounds thereof; poly-α-olefins such as 1-octene oligomer, 1-decene oligomer and 1-dodecene oligomer or hydrogenated compounds thereof; diesters such as ditridecyl glutarate, di-2-ethylhexyl adipate, diisodecyl adipate, ditridecyl adipate and di-2-ethylhexyl sebacate; polyol esters such as neopentylglycol ester, trimethylolpropane caprylate, trimethylolpropane pelargonate, pentaerythritol 2-ethylhexanoate and pentaerythritol pelargonate; aromatic synthetic oils such as alkylnaphthalenes, alkylbenzenes, and aromatic esters; and mixtures of the foregoing.

The lubricating base oil used in the present invention may be any one of the above-described mineral base oils and synthetic base oils or a mixture of two or more types selected therefrom. For example, the base oil may be one or more type of the mineral base oils, one or more type of the synthetic base oils or a mixed oil of one or more type of the mineral base oils and one or more type of the synthetic base oils.

No particular limitation is imposed on the kinematic viscosity of the lubricating base oil of the present invention. However, the lubricating base oil is preferably so adjusted that the 100° C. kinematic viscosity is preferably from 2 to 8 $mm^2/s$, more preferably from 2.5 to 6 $mm^2/s$, particularly preferably from 3 to 4.5 $mm^2/s$, most preferably 3 to 3.5 $mm^2/s$. A base oil with a 100° C. kinematic viscosity of higher than 8 $mm^2/s$ is not preferable because the resulting lubricating oil composition would be poor in low temperature viscosity characteristics while abase oil with a 100° C. kinematic viscosity of lower than 2 $mm^2/s$ is not also preferable because the resulting lubricating oil composition would be poor in lubricity due to its insufficient oil film formation at lubricating sites and large in evaporation loss of the lubricating base oil.

No particular limitation is imposed on the viscosity index of the lubricating base oil, which is, however, preferably 100 or greater, more preferably 120 or greater and usually 200 or less, preferably 160 or less. The use of a lubricating base oil having a viscosity index of greater than 100 renders it possible to produce a composition exhibiting excellent viscosity characteristics from low temperatures to high temperatures. Whilst, if the viscosity index is too high, the resulting composition would tend to be high in viscosity at low temperatures.

In order to improve the low temperature viscosity characteristics and viscosity index of the lubricating oil composition, the base oil is preferably a combination of two or more base oils having a viscosity index of 120 or greater selected from low viscosity base oils having a viscosity index of 100 or greater and a 100° C. kinematic viscosity of 2 $mm^2/s$ or higher and lower than 3.5 $mm^2/s$ and relatively high viscosity base oils having a viscosity index of 100 or greater and a 100° C. kinematic viscosity of 3.5 $mm^2/s$ or higher and 4.5 $mm^2/s$ or lower. In particular, mixing these base oils can contribute to an improvement in fuel saving properties.

The viscosity index of the above-described low viscosity base oil is preferably 105 or greater, more preferably 110 or greater while the viscosity index of the relatively high viscosity base oil is preferably 110 or greater, more preferably 120 or greater.

No particular limitation is imposed on the sulfur content of the lubricating base oil used in the present invention, which is, however, preferably 0.1 percent by mass or less, more preferably 0.05 percent by mass or less, more preferably 0.01 percent by mass or less, particularly preferably 0.005 percent by mass or less, most preferably substantially 0. A composition with excellent oxidation stability can be produced by reducing the sulfur content of the lubricating base oil.

No particular limitation is imposed on the evaporation loss of the lubricating base oil. However, the NOACK evaporation loss is preferably from 10 to 50 percent by mass, more preferably from 20 to 40 percent by mass, particularly preferably from 22 to 35 percent by mass. The use of a lubricating base oil with a NOACK evaporation loss adjusted within the above ranges renders it possible to achieve both low temperature characteristics and anti-wear properties. The term "NOACK evaporation loss" used herein denotes an evaporation loss measured in accordance with CEC L-40-T-87.

Component (A) of the lubricating oil composition of the present invention is a fatty acid amide compound represented by formula (1) below:

(1)

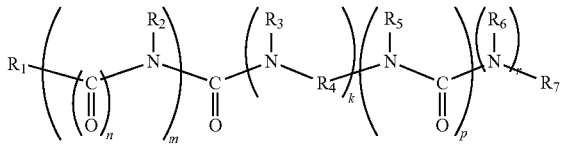

In formula (1), $R_1$ is an alkyl or alkenyl group having 10 to 30 carbon atoms, preferably a straight-chain alkyl or alkenyl group or a straight-chain alkyl or alkenyl group having one methyl group as a substituent. $R_2$ and $R_3$ are each independently hydrogen or an alkyl group having 1 to 3 carbon atoms, particularly preferably hydrogen. $R_4$ is an alkylene group having 1 to 4 carbon atoms, particularly preferably an alkylene group having 2 carbon atoms. $R_5$ and $R_6$ are each independently hydrogen or an alkyl group having 1 to 3 carbon atoms, particularly preferably hydrogen. $R_7$ is hydrogen or an alkyl or alkenyl group having 1 to 30 carbon atoms, preferably a straight-chain alkyl or alkenyl group having 10 to 30 carbon atoms. Preferably, k is an integer of 0 to 6, preferably 1 to 4, m is an integer of 0 to 2, and n, p and r are each independently an integer of 0 or 1.

In a preferable format of formula (1), $R_1$ is a straight-chain alkyl or alkenyl group having 12 or more, more preferably 16 or more, most preferably 18 or more and 26 or fewer, more preferably 24 or fewer carbon atoms. The main chain is a straight-chain alkyl or alkenyl group, more preferably a group having methyl at the α-position of the carbonyl group. Preferably, $R_7$ is in the same format as that of $R_1$. $R_1$ and $R_7$ having 10 or more carbon atoms renders it possible to produce a lubricating oil composition with improved anti-belt-noise properties. $R_1$ and $R_7$ having more than 30 carbon atoms is not preferable because the resulting composition would be degraded in viscosity characteristics at low temperatures.

Preferably, k is an integer of 2 or greater and 4 or smaller. Preferably, m is an integer of 0 or 1, most preferably 0. Preferably, p is an integer of 1, and preferably r is an integer of 0. As the result, the composition can exhibit enhanced anti-belt-noise properties.

No particular limitation is imposed on the structure of Component (B) used in the present invention if it is a thiadiazole. Examples of such a thiadiazole include a 1,3,4-thidiazole compound represented by formula (2) below, a 1,2,4-thiadiazole compound represented by formula (3) below and a 1,4,5-thidiazole compound represented by formula (4) below.

(2)

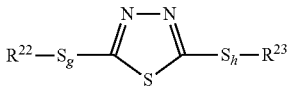

(3)

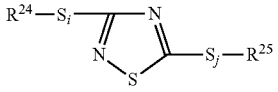

(4)

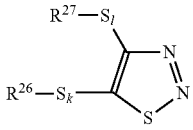

In formulas (2) to (4), $R^{22}$, $R^{23}$, $R^{24}$, $R^{25}$, $R^{26}$ and $R^{27}$ may be the same or different from one another and are each independently hydrogen or a hydrocarbon group having 1 to 30 carbon atoms, and g, h, i, j, k and 1 are each independently an integer of 0 to 8.

Examples of the hydrocarbon group having 1 to 30 carbon atoms include alkyl, cycloalkyl, alkylcycloalkyl, alkenyl, aryl, alkylaryl and arylalkyl groups.

In the present invention, Component (B) is added in an amount of 0.05 percent by mass or more, preferably 0.1 percent by mass or more and preferably 1.5 percent by mass or less, more preferably 1.2 percent by mass or less, more preferably 1 percent by mass or less, most preferably 0.5 percent by mass or less on the basis of the total mass of the lubricating oil composition with the objective of improving the metal to metal coefficient and in view of anti-wear properties and anti-seizure properties. If the amount of Component (B) exceeds 1.5 percent by mass, the resulting composition would be degraded in anti-seizure properties to the contrary.

The lubricating oil composition of the present invention comprises a phosphorus-containing additive as Component (C).

No particular limitation is imposed on the phosphorus-containing additive if it contains phosphorus in its molecule. Examples of the phosphorus-containing additive include phosphoric acid monoesters, phosphoric acid diesters, phosphoric acid triesters, phosphorus acid monoesters, phosphorus acid diesters, phosphorus acid triesters, thiophosphoric acid monoesters, thiophosphoric acid diesters, thiophosphoric acid triesters, thiophosphorus acid monoesters, thiophosphorus acid diesters, thiophosphorus acid triesters, all having a hydrocarbon group of 1 to 30 carbon atoms, salts of these esters and amines or alkanol amines or metal salts such as zinc salt of these esters.

Examples of the hydrocarbon group having 1 to 30 carbon atoms include alkyl, cycloalkyl, alkenyl, alkyl-substituted cycloalkyl, aryl, alkyl-substituted aryl and arylalkyl groups. One or more type of the groups may be contained in the additive.

In the present invention, the phosphorus-containing additive is preferably a phosphorus acid ester or phosphoric acid ester, having an alkyl group of 4 to 20 carbon atoms or an (alkyl)aryl group of 6 to 12 carbon atoms.

Alternatively, the phosphorus-containing additive is more preferably one or a mixture of two or more types selected from phosphorus acid esters having an alkyl group of 4 to 20 carbon atoms and phosphorus acid esters having an (alkyl) aryl group of 6 to 12 carbon atoms.

Furthermore, the phosphorus-containing additive is more preferably a phosphorus acid ester having an (alkyl)aryl group of 6 or 7 carbon atoms such as phenylphosphite and/or a phosphorus acid ester having an alkyl group of 4 to 8 carbon atoms. Among these phosphorus-containing additives, dibutylphosphite is most preferable.

The alkyl group may be straight-chain but is more preferably branched. This is because alkyl groups of fewer carbon atoms or branched result in higher metal-to-metal friction coefficient.

The content of the phosphorus-containing additive in the lubricating oil composition of the present invention is 0.1 percent by mass or more, usually from 0.1 to 5 percent by mass on the basis of the total mass of the lubricating oil composition.

The content is preferably from 0.001 to 0.2 percent by mass on the phosphorus concentration basis. With the objective of further enhancing anti-wear properties for metal materials and metal-to-metal friction coefficient, the content is preferably 0.005 percent by mass or more, more preferably 0.01 percent by mass or more, particularly preferably 0.02 percent by mass or more. Whilst, the content is preferably 0.15 percent by mass or less, more preferably 0.1 percent by mass or less, particularly preferably 0.08 percent by mass or less. If the content exceeds 0.15 percent by mass, the lubricating oil composition would be degraded in oxidation stability or adversely affect sealing materials.

Necessarily, the sulfur content in the lubricating oil composition of the present invention is 0.2 percent by mass or more on the sulfur basis while the phosphorus content in the composition is 0.2 percent by mass or less on the phosphorus basis.

The ratio of the sulfur content by percent by mass on the sulfur basis and the phosphorus content by percent by mass on the phosphorus basis (the ratio of the sulfur basis percent by mass/the phosphorus basis percent by mass (S/P)) in the composition is necessarily from 3.0 to 5.0.

Adjusting the mass ratio of the phosphorus-containing additive content on the phosphorus basis (P) to the sulfur content in the lubricating oil composition (S) to the above-described range renders it possible to produce a lubricating oil composition which has long-lasting anti-wear properties and anti-seizure properties while keeping the metal-to-metal friction coefficient higher. In particular, if the S/P ratio exceeds 5.0, the anti-seizure properties would be degraded. This is assumed to be caused by different action mechanisms to anti-seizure properties between the phosphorus-containing additive and sulfur-containing additive, and the balance therebetween has been found important.

Preferably, the lubricating oil composition of the present invention further comprises a polysulfide as Component (D). Examples of the polysulfide include sulfurized fats and oils, sulfurized olefins and dihydrocarbyl polysulfides.

Examples of the sulfurized fats and oils include oils such as sulfurized lard, sulfurized rapeseed oil, sulfurized ricinus oil, sulfurized soybean oil, and sulfurized rice bran oil; disulfurized fatty acids such as sulfurized oleic acid; and sulfurized esters such as sulfurized oleic methyl oleate.

Examples of the sulfurized olefin include compounds represented by formula (5):

$$R^1—S_x—R^2 \quad (5)$$

wherein $R^1$ is an alkenyl group having 2 to 15 carbon atoms, $R^2$ is an alkyl or alkenyl group having 2 to 15 carbon atoms, x is an integer of 1 to 8, preferably 2 or greater, particularly preferably 4 or greater.

The compounds can be produced by reacting an olefin having 2 to 15 carbon atoms or a dimer to tetramer thereof with sulfur or a sulfurizing agent such as sulfur chloride.

Such an olefin is preferably propylene, isobutene, or diisobutene.

The dihydrocarbyl polysulfide is a compound represented by formula (6):

$$R^3—S_y—R^4 \quad (6).$$

In formula (6), $R^3$ and $R^4$ are each independently an alkyl (including cycloalkyl) group having 1 to 20 carbon atoms, an aryl group having 6 to 20 carbon atoms, or an arylalkyl or alkylaryl group having 7 to 20 carbon atoms and may be the same or different from each other, and y is an integer of 2 to 8.

Specific examples of $R^3$ and $R^4$ include methyl, ethyl, n-propyl, isopropyl, n-butyl, isobutyl, sec-butyl, tert-butyl, various pentyls, various hexyls, various heptyls, various octyls, various nonyls, various decyls, various dodecyls, cyclohexyl, phenyl, naphthyl, tolyl, xylyl, benzyl, and phenetyl groups.

Preferred examples of the dihydrocarbyl polysulfide include dibenzyl polysulfide, di-tert-nonylpolysulfide, didodecylpolysulfide, di-tert-butylpolysulfide, dioctylpolysulfide, diphenylpolysulfide, and dicyclohexylpolysulfide.

Component (D), i.e., polysulfide used in the present invention is preferably a sulfurized olefin, most preferably that represented by formula (5) wherein x is an integer of 4 to 8.

In the present invention, Component (D) is added in an amount of 0.05 percent by mass or more, preferably 0.1 percent by mass or more and preferably 1.5 percent by mass or less, more preferably 1.2 percent by mass or less, more preferably 1 percent by mass or less, most preferably 0.5 percent by mass or less on the basis of the total mass of the lubricating oil composition with the objective of improving the metal-to-metal friction coefficient and in view of anti-wear properties and anti-seizure properties. If the amount of Component (D) exceeds 1.5 percent by mass, the resulting composition would be largely degraded in oxidation stability.

In the present invention, a friction modifier and/or a metallic detergent may be blended in the lubricating oil composition of the present invention alone or in combination. Blending of these additives in the composition of the present invention renders it possible to produce a lubricating oil composition which is more suitable for a belt type continuously variable transmission equipped with a wet friction clutch.

The friction modifier that can be used in combination with the lubricating oil composition of the present invention may be any compound that is usually used as a friction modifier for lubricating oil. Examples of such a compound include amine compounds, fatty acid amides and fatty acid metal salts, each having in their molecules an alkyl or alkenyl group having 6 to 30 carbon atoms, particularly a straight-chain alkyl or alkenyl group having 6 to 30 carbon atoms.

The above-exemplified amine compounds include succinimides that are reaction products with polyamines. These include those modified with a boric compound or a phosphorus compound.

Examples of the amine compound include straight-chain or branched, preferably straight-chain aliphatic monoamines and aliphatic polyamines, each having 6 to 30 carbon atoms, alkyleneoxide adducts of these aliphatic amines, salts of these amine compounds and phosphoric acid esters or phosphorus acid esters, and boric acid-modified products of (phosphorus) phosphoric acid ester salts of these amine compounds.

Particularly preferred are alkyleneoxide adducts of amine compounds; salts of these amine compounds and phosphoric acid esters (for example, di-2-ethylhexylphosphate), phosphorus acid esters (for example, di-2-ethylhexylphosphate); boric acid-modified products of (phosphorus)phosphoric acid ester salts of these amine compounds; and mixtures thereof.

Examples of the fatty acid metal salt include alkaline earth metal salts (magnesium salt, calcium salt) and zinc salts of straight-chain or branched, preferably straight-chain fatty acids having 7 to 31 carbon atoms. More specifically, particularly preferred are calcium laurate, calcium myristate, calcium palmitate, calcium stearate, calcium oleate, coconut oil fatty acid calcium, a synthetic mixed fatty acid calcium having 12 or 13 carbon atoms, zinc laurate, zinc myristate, zinc palmitate, zinc stearate, zinc oleate, coconut oil fatty acid zinc, a synthetic mixed fatty acid zinc having 12 or 13 carbon atoms, and mixtures thereof.

In the present invention, any one or more type of compound selected from these friction modifiers may be blended in any amount but the content thereof is usually preferably from 0.01 to 5 percent by mass, more preferably from 0.03 to 3 percent by mass on the basis of the total mass of the lubricating oil composition.

The metallic detergent that can be used in combination with the lubricating oil composition of the present invention may be any compound that is usually used as a metallic detergent for lubricating oil. For example, alkali metal or alkaline earth metal sulfonates, phenates, salicylates and naphthenates may be used in combination. Examples of the alkali metal include sodium and potassium. Examples of the alkaline earth metal include calcium and magnesium. More specifically, the metallic detergent are preferably calcium or magnesium sulfonate, phenate and salicylate. Among these detergents, calcium sulfonate is preferably used.

The total base number of these metallic detergents is from 0 to 500 mgKOH/g, and the content thereof is preferably 0.001 to 0.5 percent by mass on the alkali metal or alkaline earth metal basis on the basis of the total mass of the lubricating oil composition. The upper limit is preferably 0.1 percent by mass, particularly preferably 0.05 percent by mass or less with the objective of preventing the friction coefficient from reducing due to clogging of the friction material of a clutch plate.

In order to further enhance the properties of the lubricating oil composition of the present invention, it may be blended with any one or more of conventional lubricating oil additives, such as ashless dispersants, viscosity index improvers, anti-oxidants, corrosion inhibitors, anti-foaming agents and colorants.

The ashless dispersants that can be used in combination with the lubricating oil composition of the present invention may be any compounds that are used as ashless dispersants for lubricating oil. Examples of such compounds include nitrogen-containing compounds having in their molecules at least one alkyl or alkenyl group having 40 to 400, preferably 60 to 350 carbon atoms, bis-type or mono-type succinimides having an alkenyl group having 40 to 400 carbon atoms, preferably 60 to 350 carbon atoms, and modified products produced by allowing these compounds to react with boric acid, phosphoric acid, carboxylic acid or derivatives thereof, or a sulfur compound. Any one or more of these compounds may be used in combination.

The alkyl or alkenyl group referred herein may be straight-chain or branched but is preferably a branched alkyl or alkenyl group derived from oligomers of olefins such as propylene, 1-butene or isobutylene or a cooligomer of ethylene and propylene. The alkyl or alkenyl group is preferably polybutenyl group derived from polymers produced by polymerizing a butene mixture or a high purity isobutylene with an aluminum chloride-based catalyst or a boron fluoride-based catalyst, particularly preferably those from which a halogen, compound is removed.

If the carbon number of the alkyl or alkenyl group is fewer than 40, the ashless dispersant would be poor in detergent dispersibility. Whilst, if the carbon number of the alkyl or alkenyl group exceeds 400, the resulting lubricating oil composition would be degraded in low temperature fluidity. Although the content of these compounds are arbitrarily selected, it is preferably from 0.1 to 10 percent by mass, more preferably 1 to 8 percent by mass on the basis of the total mass of the lubricating oil composition. The ashless dispersants that may be used in combination in the present invention are particularly preferably succinimides having a polybutenyl group and a weight-average molecular weight of 700 to 3,500, preferably 900 to 2,000 and/or boric acid-modified compounds thereof with the objective of further improving shifting properties. With the objective of enhancing the ability to avoid the peel-off of a wet clutch, the ashless dispersants are blended with preferably a boric acid-modified succinimide, more preferably a boric acid-modified succinimide as one type of component.

Specific examples of viscosity index improvers that can be used in combination with the lubricating oil composition of the present invention include non-dispersant type viscosity index improvers such as copolymers of one or more monomers selected from various methacrylic acid esters or hydrogenated compounds thereof; and dispersant type viscosity index improvers such as copolymers of various methacrylic acid esters further containing nitrogen compounds. Specific examples of other viscosity index improvers include non-dispersant- or dispersant-type ethylene-α-olefin copolymers of which α-olefin may be propylene, 1-butene, or 1-pentene, or a hydrogenated compound thereof; polyisobutylenes or hydrogenated compounds thereof; styrene-diene hydrogenated copolymers; styrene-maleic anhydride ester copolymers; and polyalkylstyrenes.

The molecular weight of these viscosity index is necessarily selected, taking account of the shear stability thereof. Specifically, the number-average molecular weight of the non-dispersant or dispersant type polymethacrylate is from 5,000 to 150,000, preferably from 5,000 to 35,000. The number-average molecular weight of polyisobutylenes or hydrogenated compounds thereof is from 800 to 5,000, preferably from 1,000 to 4,000. The number-average molecular weight of ethylene-α-olefin copolymers or hydrogenated compounds thereof is from 800 to 150,000, preferably from 3,000 to 12,000. Among these viscosity index improvers, the use of ethylene-α-olefin copolymers or hydrogenated compounds thereof renders it possible to produce a lubricating oil composition which is particularly excellent in shear stability. One or more compounds selected from these viscosity index improvers may be blended in any amount in the lubricating oil composition of the present invention. However, the content of the viscosity index improver is usually from 0.1 to 40.0 percent by mass, on the basis of the total amount of the composition.

The anti-oxidant may be any anti-oxidant that has been usually used in lubricating oil, such as phenol- or amine-based compounds. Specific examples of the anti-oxidant include alkylphenols such as 2-6-di-tert-butyl-4-methylphenol; bisphenols such as methylene-4,4-bisphenol(2,6-di-tert-butyl-4-methylphenol); naphthylamines such as phenyl-α-naphthylamine; dialkyldiphenylamines; zinc dialkyldithiophosphoric acids such as di-2-ethylhexyldithiophosphoric acid; and esters of (3,5-di-tert-butyl-4-hydroxyphenyl) fatty acid (propionic acid) with a monohydric or polyhydric alcohol such as methanol, octadecanol, 1,6-hexanediol, neopentyl glycol, thiodiethylene glycol, triethylene glycol and pentaerythritol. Any one or more of compounds selected from these compounds may be contained in any amount, which is, however, usually from 0.01 to 5 percent by mass on the total composition mass basis.

The corrosion inhibitors that can be used in combination with the lubricating oil composition of the present invention may be any compounds that have been usually used as corrosion inhibitors for lubricating oil. Examples of such compounds include benzotriazole-, tolyltriazole-, thiadiazole-, and imidazole-types compounds. Any one or more of compounds selected from these compounds may be contained in any amount, which is, however, usually from 0.01 to 3.0 percent by mass on the total composition mass basis.

The anti-foaming agent that can be used in combination with the lubricating oil composition of the present invention may be any compounds that have been usually used as anti-foaming agents for lubricating oil. Examples of such compounds include silicones such as dimethylsilicone and fluorosilicone. Any one or more of compounds selected from these compounds may be contained in any amount, which is, however, usually from 0.001 to 0.05 percent by mass on the total composition mass basis.

The colorants that may be used in combination with the transmission lubricating oil composition of the present invention may be any colorants and contained in any amount, which is, however, desirously from 0.001 to 1.0 percent by mass on the basis of the total mass of the lubricating oil composition.

EXAMPLES

Hereinafter, the present invention will be described in more detail by way of the following examples and comparative examples, which should not be construed as limiting the scope of the invention.

Examples 1 to 11 and Comparative Examples 1 to 11

Lubricating oil compositions of Example 1 to 11 and Comparative Examples 1 to 11 set forth in Table 1 were prepared and subjected to the following tests, the results of which are also set forth in Table 1. In Table 1, the ratio of the base oils is based on the total mass of the base oil and the amount of each additive is based on the total mass of the composition.

(1) Last non-seizure load (LNSL) evaluated by Four-Ball Extreme Pressure Test Method in accordance with ASTM D2783

(2) Wear scar diameter evaluated by Four-Ball Extreme Pressure Test Method in accordance with ASTM D4172

(3) Seizure load evaluated by Falex Seizure test in accordance with ASTM D 3233

(4) Metal-to-metal friction coefficient evaluated by LFW-1 Test in accordance with JASO Method (High Load Method) M358:2005

The inventors of the present invention has found a method for evaluation correlating to belt noise. Specifically, the method is to calculate "b" using the equation given below wherein X is time intervals of 2/100 second from 1 second to 3 seconds after the slipping speed is constantly accelerated from 0 m/s to 0.3 m/s for 1 second at a load of 2000 N using an LFW-1 test machine and Y is torque at each X. A lubricating oil with "b" of negative is unlikely to generate belt noise.

$$b=(n\Sigma XY-(\Sigma X)(\Sigma Y))/(n\Sigma X^2-(\Sigma X)^2)$$

TABLE 1

| | | Example 1 | Example 2 | Example 3 | Example 4 | Example 5 | Example 6 | Example 7 | Example 8 |
|---|---|---|---|---|---|---|---|---|---|
| Base oil a (total base oil mass basis) | mass % | 50 | 50 | 50 | 50 | 50 | 50 | 50 | 50 |
| Base oil b (total base oil mass basis) | mass % | 50 | 50 | 50 | 50 | 50 | 50 | 50 | 50 |
| Additive composition (total composition mass basis) | | | | | | | | | |
| Friction modifier (A)-1 | mass % | 1.00 | 0.80 | 1.20 | 1.00 | 1.00 | 0.70 | 1.00 | 1.00 |
| Friction modifier 1 | mass % | | | | | | | | |
| Friction modifier 2 | mass % | | | | | | | | |
| Friction modifier 3 | mass % | | | | | | | | |
| Friction modifier 4 | mass % | | | | | | | | |
| Friction modifier 5 | mass % | | | | | | | | |
| Thiadiazole (B)-1 mass % | mass % | 0.20 | 0.20 | 0.20 | 0.20 | 0.11 | 0.20 | 0.20 | 0.20 |
| Phosphorus-containing additive (C)-1 | mass % | 0.32 | 0.32 | 0.32 | 0.19 | 0.45 | 0.32 | 0.32 | 0.32 |
| Phosphorus-containing additive (C)-2 | mass % | | | | | | | | |
| Phosphorus-containing additive (C)-3 | mass % | | | | | | * | | |
| Polysulfide (D)-1 | mass % | 0.13 | 0.13 | 0.13 | 0.10 | 0.36 | 0.13 | | |
| Polysulfide (D)-2 | mass % | | | | | | | 0.28 | |
| Polysulfide (D)-3 | mass % | | | | | | | | 0.22 |
| Viscosity index improver 1 | mass % | 15 | 15 | 15 | 15 | 15 | 15 | 15 | 15 |
| Viscosity index improver 2 | mass % | 2.5 | 2.5 | 2.5 | 2.5 | 2.5 | 2.5 | 2.5 | 2.5 |
| Performance additives | mass % | 6 | 6 | 6 | 6 | 6 | 6 | 6 | 6 |
| Sulfur and phosphorus contents in the composition | | | | | | | | | |
| Sulfur basis | mass % | 0.25 | 0.25 | 0.25 | 0.24 | 0.28 | 0.25 | 0.25 | 0.25 |
| Phosphorus basis | mass % | 0.07 | 0.07 | 0.07 | 0.05 | 0.09 | 0.07 | 0.07 | 0.07 |
| Sulfur/phosphorus (S/P) ratio | | 3.6 | 3.6 | 3.6 | 4.8 | 3.1 | 3.6 | 3.6 | 3.6 |
| Four-Ball Extreme LNSL Pressure Teat 1800 rpm | N | 785 | 785 | 785 | 785 | 981 | 785 | 618 | 618 |
| Wear scar diameter | mm | 0.39 | 0.43 | 0.38 | 0.43 | 0.38 | 0.41 | 0.49 | 0.47 |
| LVFA durability test (JASO method) | h | >400 | 336 | >400 | >400 | >400 | 400 | >400 | >400 |
| LFW-1 test (Friction coefficient) | 0.5 m/s | 0.129 | 0.133 | 0.125 | 0.127 | 0.134 | 0.133 | 0.125 | 0.123 |
| LFW-1 test (gradient) | (100° C.) | −0.25 | −0.18 | −0.30 | −0.30 | −0.18 | −0.21 | −0.32 | −0.31 |
| Anti-noise properties (0.00 or less) | (60° C.) | −0.15 | −0.05 | −0.27 | −0.27 | −0.05 | −0.02 | −0.22 | −0.23 |

| | | Example 9 | Example 10 | Example 11 | Comparative Example 1 | Comparative Example 2 | Comparative Example 3 | Comparative Example 4 |
|---|---|---|---|---|---|---|---|---|
| Base oil a (total base oil mass basis) | mass % | 50 | 50 | 50 | 50 | 50 | 50 | 50 |
| Base oil b (total base oil mass basis) | mass % | 50 | 50 | 50 | 50 | 50 | 50 | 50 |
| Additive composition (total composition mass basis) | | | | | | | | |
| Friction modifier (A)−1 | mass % | 1.00 | 1.00 | 1.00 | 0.40 | 0.40 | 1.00 | 1.00 |
| Friction modifier 1 | mass % | | | | | | | |
| Friction modifier 2 | mass % | | | | | | | |
| Friction modifier 3 | mass % | | | | | | | |
| Friction modifier 4 | mass % | | | | | | | |
| Friction modifier 5 | mass % | | | | | | | |
| Thiadiazole (B)-1 mass % | mass % | 0.20 | 0.20 | 0.20 | 0.20 | | 1.73 | |
| Phosphorus-containing additive (C)-1 | mass % | | | 0.19 | 0.32 | 0.32 | 0.58 | |
| Phosphorus-containing additive (C)-2 | mass % | 0.33 | | | | | | |
| Phosphorus-containing additive (C)-3 | mass % | | 0.77 | | | | | |
| Polysulfide (D)-1 | mass % | 0.13 | 0.13 | | 0.13 | | 0.13 | |
| Polysulfide (D)-2 | mass % | | | | | | | |
| Polysulfide (D)-3 | mass % | | | | | | | |
| Viscosity index improver 1 | mass % | 15 | 15 | 15 | 15 | 15 | 15 | 15 |
| Viscosity index improver 2 | mass % | 2.5 | 2.5 | 2.5 | 2.5 | 2.5 | 2.5 | 2.5 |
| Performance additives | mass % | 6 | 6 | 6 | 6 | 6 | 6 | 6 |
| Sulfur and phosphorus contents in the composition | | | | | | | | |
| Sulfur basis | mass % | 0.25 | 0.25 | 0.21 | 0.25 | 0.14 | 0.80 | 0.14 |
| Phosphorus basis | mass % | 0.07 | 0.07 | 0.05 | 0.07 | 0.07 | 0.11 | 0.02 |
| Sulfur/phosphorus (S/P) ratio | | 3.6 | 3.6 | 4.2 | 3.6 | 2.0 | 7.2 | 7.0 |
| Four-Ball Extreme LNSL Pressure Teat 1800 rpm | N | 618 | 618 | 618 | 785 | 618 | 981 | 490 |
| Wear scar diameter | mm | 0.46 | 0.49 | 0.46 | 0.45 | 0.42 | 0.51 | 0.55 |
| LVFA durability test (JASO method) | h | >400 | 312 | >400 | 72 | 96 | 384 | >400 |
| LFW-1 test (Friction coefficient) | 0.5 m/s | 0.124 | 0.121 | 0.118 | 0.137 | 0.108 | 0.128 | 0.082 |
| LFW-1 test (gradient) | (100° C.) | −0.09 | −0.11 | −0.40 | 0.01 | −0.07 | 0.01 | −0,42 |
| Anti-noise properties (0.00 or less) | (60° C.) | −0.02 | −0.01 | −0.36 | 0.08 | −0.02 | 0.04 | −0.35 |

TABLE 1-continued

| | | Comparative Example 5 | Comparative Example 6 | Comparative Example 7 | Comparative Example 8 | Comparative Example 9 | Comparative Example 10 | Comparative Example 11 |
|---|---|---|---|---|---|---|---|---|
| Base oil a (total base oil mass basis) | mass % | 50 | 50 | 50 | 50 | 50 | 50 | 50 |
| Base oil b (total base oil mass basis) | mass % | 50 | 50 | 50 | 50 | 50 | 50 | 50 |
| Additive composition (total composition mass basis) | | | | | | | | |
| Friction modifier (A)−1 | mass % | 1.00 | | | | | | 1.00 |
| Friction modifier 1 | mass % | | 0.10 | | | | | |
| Friction modifier 2 | mass % | | | 0.10 | | | | |
| Friction modifier 3 | mass % | | | | 0.10 | | | |
| Friction modifier 4 | mass % | | | | | 1.00 | | |
| Friction modifier 5 | mass % | | | | | | 0.40 | |
| Thiadiazole (B)-1 mass % | mass % | | 0.20 | 0.20 | 0.20 | 0.20 | 0.20 | |
| Phosphorus-containing additive (C)-1 | mass % | 0.32 | 0.32 | 0.32 | 0.32 | 0.32 | 0.32 | 0.19 |
| Phosphorus-containing additive (C)-2 | mass % | | | | | | | |
| Phosphorus-containing additive (C)-3 | mass % | | | | | | | |
| Polysulfide (D)-1 | mass % | | 0.13 | 0.13 | 0.13 | 0.13 | 0.13 | 0.10 |
| Polysulfide (D)-2 | mass % | | | | | | | |
| Polysulfide (D)-3 | mass % | | | | | | | |
| Viscosity index improver 1 | mass % | 15 | 15 | 15 | 15 | 15 | 15 | 15 |
| Viscosity index improver 2 | mass % | 2.5 | 2.5 | 2.5 | 2.5 | 2.5 | 2.5 | 2.5 |
| Performance additives | mass % | 6 | 6 | 6 | 6 | 6 | 6 | 6 |
| Sulfur and phosphorus contents in the composition | | | | | | | | |
| Sulfur basis | mass % | 0.14 | 0.25 | 0.25 | 0.25 | 0.25 | 0.25 | 0.17 |
| Phosphorus basis | mass % | 0.07 | 0.07 | 0.07 | 0.07 | 0.07 | 0.08 | 0.05 |
| Sulfur/phosphorus (S/P) ratio | | 2.0 | 3.6 | 3.6 | 3.6 | 3.6 | 3.1 | 3.4 |
| Four-Ball Extreme LNSL Pressure Teat 1800 rpm | N | 618 | 785 | 785 | 785 | 785 | 785 | 618 |
| Wear scar diameter | mm | 0.43 | 0.43 | 0.42 | 0.44 | 0.44 | 0.40 | 0.50 |
| LVFA durability test (JASO method) | h | >400 | 48 | 48 | 24 | 240 | <24 | >400 |
| LFW-1 test (Friction coefficient) | 0.5 m/s | 0.108 | 0.078 | 0.098 | 0.134 | 0.133 | 0.118 | 0.098 |
| LFW-1 test (gradient) | (100° C.) | −0.32 | 0.25 | 0.21 | 0.02 | 0.61 | 0.52 | −0.23 |
| Anti-noise properties (0.00 or less) | (60° C.) | −0.22 | 0.35 | 0.31 | 0.20 | 0.69 | 0.57 | −0.11 |

Base oil a: hydrorefined mineral o 40° C.: 19.57 $mm^2/s$, 100° C.: 4.23 $mm^2/s$, VI: 122, sulfur content: <10 ppm Base oil b: hydrorefined mineral o 40° C.: 12.43 $mm^2/s$, 100° C.: 3.12 $mm^2/3$, VI: 112, sulfur content: <10 ppm Friction modifier (A)-1: polyalkylene polyamine diisostearic acid amide Friction modifier 1: oleylamine Friction modifier 2: monostearylamine ethyleneoxide adduct Friction modifier 3: monooleic glyceride Friction modifier 4: isostearylsuccinimide tetraethyleneamine Friction modifier 5; oleylamine salt of monostearyl phosphorous acid Thiadiazole (B)-1: 1,3,4-thiadiazole compound sulfur content: 36.0

Phosphorus-containing additive (C)-1: dibutylphosphite P content: 15.5%

Phosphorus-containing additive (C)-2: diphenylhydrogen phosphite P content: 13.2%

Phosphorus-containing additive (C)-3: dilaurylhydrogen phosphite P content; 6.5%

Polysulfide (D)-1: sulfurized olefin (active) $R—S_x—R$ ($X \geq 4$) sulfur content: 30.5%

Polysulfide (D)-2: sulfurized olefin {inactive) $R—S_x—R$ ($4 > X$) sulfur content: 14.5%

Polysulfide (D)-3: sulfurized ester (active) $R—S_x—R$ ($X \geq 4$) sulfur content: 18.0%

Viscosity index improver 1: polymethacrylate weight-average molecular weight (Mw): 20000

Viscosity index improver 2: polymethacrylate weight-average molecular weight (Mw): 50000

Performance additive: additive package for continuously variable transmissions Main additives: boron-containing succinimide, amount 3 mass %, metallic detergent: sulfonate (500BN), amount 0.19 mass %, diluting oil and the like LFW-1 test: JX method (Sweep method) load (2000N), slipping speed (0.3 m/s), oil temperatures (60° C., 100° C.)

Calculate the gradient of the friction coefficient value in a stable state when a test piece (ring) is slipped at 0.3 m/s in terms of slipping speed against a block Gradient of regression line (b) = $(n\Sigma XY - (\Sigma X)(\Sigma Y))/(n\Sigma X^2 - (\Sigma X)^2)$

*Properties where friction coefficient decreases over elapse time, i.e., as larger the negative gradient, the composition is more excellent in anti-noise properties As apparent from Table 1, the composition of Comparative Example 1 containing friction modifier (A)-1 corresponding to the fatty acid amide compound, i.e., Component (A) represented by formula (1) in an amount of less than 0.5 percent by mass exhibits the value indicating anti-belt-noise properties of positive and thus was poor in anti-noise properties. The composition of Comparative Example 11 containing no thiadiazole of Component (B) is lower in metal-to-metal friction coefficient evaluated by LFW-1 than the composition of Example 4 containing thiadiazole. The composition of Comparative Example 4 containing no phosphorus-containing additive of Component (C) is lower in last non-seizure load (LNSL) evaluated by Four-Ball Extreme Pressure Test and large in wear scar diameter.

The compositions of Comparative Examples 2, 4, 5 and 11 not containing sulfur in an amount of 0.2 percent by mass or more are lower in metal-to-metal friction coefficient due to one of the causes thereof that is the lack of Component (B). The composition of Comparative Example 2 containing no sulfur-containing additive is recognized to be degraded in the durability of anti-shudder properties (LVFA durability test). The composition of Comparative Example 3 wherein sulfur is contained in a large amount but phosphorus is contained in an amount of 0.2 percent by mass on the phosphorus basis and the ratio of the sulfur basis percent by mass/phosphorus basis percent by mass (S/P) deviates the range of 3.0 to 5.0 is found to be insufficient in anti-belt-noise properties.

The invention claimed is:

1. A lubricating oil composition comprising a lubricating base oil having a sulfur content of 0.01 percent by mass or less and on the basis of the total mass of the composition:

(A) 0.5 percent by mass or more and 1.2 percent by mass or less of a fatty acid amide compound represented by formula (1);

(B) 0.05 percent by mass or more and 1.5 percent by mass or less of thiadiazole; and (C) 0.1 percent by mass of a phosphorus-containing additive, and containing sulfur in an amount of 0.2 percent by mass or more on the basis of sulfur and phosphorus in an amount of 0.2 percent by mass or less on the basis of phosphorus, the ratio of the sulfur basis percent by mass/the phosphorus basis percent by mass (S/P) being from 3.0 to 4.8:

(1)

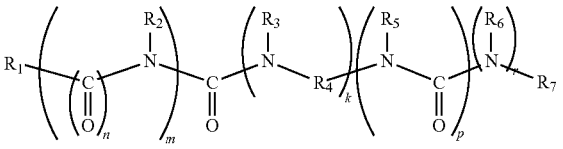

wherein $R_1$ is an alkyl or alkenyl group having 10 to 30 carbon atoms, $R_2$, $R_3$, $R_5$ and $R_6$ are each independently hydrogen or an alkyl group having 1 to 3 carbon atoms, $R_7$ is hydrogen or an alkyl or alkenyl group having 1 to 30 carbon atoms, $R_4$ is an alkylene group having 1 to 4 carbon atoms, k is an integer of 0 to 6, m is an integer of 0 to 2, and n, p and r are each an integer of 0 to 1, and wherein k, m, n, p, and r are not all 0.

2. The lubricating oil composition according to claim 1 further comprising (D) a polysulfide in an amount of 0.05 percent by mass or more on the basis of the total mass of the composition.

3. The lubricating oil composition according to claim 2 wherein (D) the polysulfide is a sulfurized olefin represented by formula (5):

$$R^1—S_X—R^2 \quad (5)$$

wherein $R^1$ is an alkenyl group having 2 to 15 carbon atoms, $R^2$ is an alkyl or alkenyl group having 2 to 15 carbon atoms, and x is an integer of 4 to 8.

4. The lubricating oil composition according to claim 1, wherein (C) the phosphorus-containing additive is at least one phosphorous acid ester having an (alkyl)aryl group of 6 to 7 carbon atoms and a phosphorous acid ester having an alkyl group of 4 to 8 carbon atoms.

5. The lubricating oil composition according to claim 1, wherein the value "b" is negative at oil temperatures of 60° C. and 100° C. when it is calculated using the following equation wherein X is time intervals of 2/100 second from 1 second to 3 seconds after the slipping speed is constantly accelerated from 0 m/s to 0.3 m/s for 1 second at a load of 2000 N using an LFW-1 test machine and Y is torque at each X:

$$b=(n\Sigma XY-(\Sigma X)(\Sigma Y))/(n\Sigma X^2-(\Sigma X)^2).$$

6. The lubricating oil composition according to claim 2, wherein (C) the phosphorus-containing additive is at least one of a phosphorous acid ester having an (alkyl)aryl group of 6 to 7 carbon atoms and a phosphorous acid ester having an alkyl group of 4 to 8 carbon atoms.

7. The lubricating oil composition according to claim 3, wherein (C) the phosphorus-containing additive is at least one of a phosphorous acid ester having an (alkyl)aryl group of 6 to 7 carbon atoms and a phosphorous acid ester having an alkyl group of 4 to 8 carbon atoms.

8. The lubricating oil composition according to claim 2, wherein the value "b" is negative at oil temperatures of 60° C. and 100° C. when it is calculated using the following equation wherein X is time intervals of 2/100 second from 1 second to 3 seconds after the slipping speed is constantly accelerated from 0 m/s to 0.3 m/s for 1 second at a load of 2000 N using an LFW-1 test machine and Y is torque at each X:

$$b=(n\Sigma XY-(\Sigma X)(\Sigma Y))/(n\Sigma X^2-(\Sigma X)^2).$$

9. The lubricating oil composition according to claim 3, wherein the value "b" is negative at oil temperatures of 60° C. and 100° C. when it is calculated using the following equation wherein X is time intervals of 2/100 second from 1 second to 3 seconds after the slipping speed is constantly accelerated from 0 m/s to 0.3 m/s for 1 second at a load of 2000 N using an LFW-1 test machine and Y is torque at each X:

$$b=(n\Sigma XY-(\Sigma X)(\Sigma Y))\Sigma(n\Sigma X^2-(\Sigma X)^2).$$

10. The lubricating oil composition according to claim 4, wherein the value "b" is negative at oil temperatures of 60° C. and 100° C. when it is calculated using the following equation wherein X is time intervals of 2/100 second from 1 second to 3 seconds after the slipping speed is constantly accelerated from 0 m/s to 0.3 m/s for 1 second at a load of 2000 N using an LFW-1 test machine and Y is torque at each X:

$$b=(n\Sigma XY-(\Sigma X)(\Sigma Y))\Sigma(n\Sigma X^2-(\Sigma X)^2).$$

* * * * *